US007955160B2

(12) United States Patent
Cobb et al.

(10) Patent No.: US 7,955,160 B2
(45) Date of Patent: Jun. 7, 2011

(54) GLASS MOLD POLISHING METHOD AND STRUCTURE

(75) Inventors: Michael A. Cobb, Croton on Hudson, NY (US); Dinesh R. Koli, Hartsdale, NY (US); Michael F. Lofaro, Stamford, CT (US); Dennis G. Manzer, Bedford Hills, NY (US); Paraneetha Poloju, White Plains, NY (US); James A. Tornello, Cortlandt Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 397 days.

(21) Appl. No.: 12/135,315

(22) Filed: Jun. 9, 2008

(65) Prior Publication Data

US 2009/0305616 A1 Dec. 10, 2009

(51) Int. Cl.
*B24B 1/00* (2006.01)

(52) U.S. Cl. ..... 451/41; 451/287; 451/291

(58) Field of Classification Search ..... 451/41–44, 451/285–290

See application file for complete search history.

(56) References Cited

U.S. PATENT DOCUMENTS 2,729,040 A * 1/1956 Wallace et al. ..... 451/388
3,865,359 A * 2/1975 Caroli ..... 269/21
5,451,547 A 9/1995 Himi et al.
5,607,341 A 3/1997 Leach
5,702,290 A 12/1997 Leach
5,733,175 A 3/1998 Leach
5,836,807 A 11/1998 Leach
6,363,747 B1 * 4/2002 Budinski et al. ..... 65/26
2004/0110366 A1 * 6/2004 MacKay et al. ..... 438/613
2004/0119174 A1 * 6/2004 Hofmann et al. ..... 264/1.32
2004/0137832 A1 * 7/2004 Moon ..... 451/285
2005/0136806 A1 * 6/2005 Boo et al. ..... 451/41
2005/0153635 A1 * 7/2005 Boo et al. ..... 451/285

* cited by examiner

*Primary Examiner* — Maurina Rachuba

(74) *Attorney, Agent, or Firm* — Schmeiser, Olsen & Watts; Daniel P. Morris

(57) ABSTRACT

A glass mold polishing structure and method. The method includes providing a polishing tool comprising mounting plate, a chuck plate over and mechanically attached to the mounting plate, and a pad structure over and mechanically attached to the chuck plate. A retaining structure is attached the chuck plate. A glass mold comprising a plurality of cavities is placed on the pad structure and within a perimeter formed by the retaining structure. A vacuum device is attached to the chuck plate. The vacuum device is activated such that a vacuum is formed and mechanically attaches the glass mold to the pad structure. The polishing tool comprising the glass mold mechanically attached to the pad structure is placed over and in contact with the polishing pad. The polishing tool comprising the glass mold is rotated. The glass mold is polished as a result of the rotation.

23 Claims, 6 Drawing Sheets

GLASS MOLD POLISHING METHOD AND STRUCTURE

FIELD OF THE INVENTION

The present invention relates to a method and associated structure for polishing a glass mold.

BACKGROUND OF THE INVENTION

Removing unwanted portions of structures typically comprises a complicated and unreliable process. Accordingly, there exists a need in the art to overcome at least one of the deficiencies and limitations described herein above.

SUMMARY OF THE INVENTION

The present invention provides a method comprising:

providing a polishing tool comprising mounting plate, a chuck plate over and mechanically attached to said mounting plate, and a pad structure over and mechanically attached to said chuck plate, wherein the chuck plate comprises a first plurality of thru-holes, wherein the pad structure comprises a second plurality of thru-holes, and wherein each thru-hole of the second plurality of thru-holes is located over an associated thru-hole of the first plurality of thru-holes;

mechanically attaching a retaining structure to the chuck plate;

placing a glass mold comprising a plurality of cavities on the pad structure and within a perimeter formed by the retaining structure, wherein a bottom surface of the glass mold is in contact with the pad structure, and wherein the plurality of cavities are formed within a top surface of the glass mold;

attaching a vacuum device to the chuck plate;

activating the vacuum device such that a vacuum is formed within each thru-hole of the second plurality of thru-holes and each associated thru-hole of the first plurality of thru-holes, wherein the vacuum mechanically attaches the bottom surface of the glass mold to the pad structure;

placing the polishing tool comprising the glass mold mechanically attached to the pad structure over a polishing pad such that the top surface of the glass mold is in contact with the polishing pad;

applying a polishing substance to the polishing pad;

first rotating at a first speed and in a first direction, the polishing tool comprising the glass mold mechanically attached to the pad structure; and polishing for a specified time period, the glass mold.

The present invention provides a structure comprising:

a polishing tool comprising mounting plate, a chuck plate over and mechanically attached to the mounting plate, and a pad structure over and mechanically attached to the chuck plate, wherein the chuck plate comprises a first plurality of thru-holes, wherein the pad structure comprises a second plurality of thru-holes, and wherein each thru-hole of the second plurality of thru-holes is located over an associated thru-hole of the first plurality of thru-holes;

a retaining structure mechanically attached to the chuck plate;

a glass mold comprising a plurality of cavities placed on the pad structure and within a perimeter formed by the retaining structure, wherein a bottom surface of the glass mold is in contact with the pad structure, and wherein the plurality of cavities are formed within a top surface of the glass mold;

a vacuum device attached to the chuck plate, wherein the vacuum device is configured to form a vacuum within each thru-hole of the second plurality of thru-holes and each associated thru-hole of the first plurality of thru-holes, and wherein the vacuum mechanically attaches the bottom surface of the glass mold to the pad structure; and a polishing pad in mechanical contact with the top surface of the glass mold, wherein the polishing tool is configured to rotate at a first speed and in a first direction and polish the glass mold for a specified time period.

The present invention advantageously provides a simple method and associated apparatus for removing unwanted portions of structures.

DETAILED DESCRIPTION OF THE INVENTION

Figure 1A:
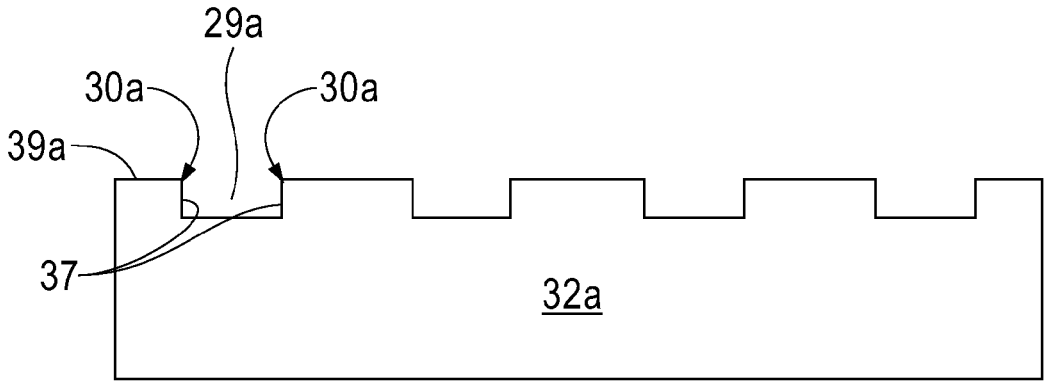
FIG. 1A illustrates a cross sectional view of a mold used for applying solder to an electrical structure, in accordance with embodiments of the present invention.

FIG. 1A illustrates a cross sectional view of a mold 32*a* used for forming solder balls and applying the solder balls to an electrical structure, in accordance with embodiments of the present invention. Mold 32*a* may comprise any material including, inter alia, glass, metal, plastic, etc. Mold 32*a* may comprise any shape including, inter alia, rectangular, circular, triangular, etc. Mold 32*a* is used to form solder balls. Additionally, mold 32*a* may be used to apply the solder balls to any type of electrical structure including, inter alia, a semiconductor device, a semiconductor wafer, a substrate (e.g., a printed circuit board, a chip carrier, etc), etc. Mold 32*a* comprises cavities 29*a* (e.g., surface pits) that are used to form and hold injection molded solder for application to an electrical structure. Although mold 32*a* comprises four cavities 29*a*, note that mold 32*a* may comprise any number of cavities (e.g., millions). In the case of a glass mold (i.e., mold 32*a*), cavities 29*a* may be formed by: chemically etching the glass through a mask and then removing the mask, a laser process, etc. Cavities 29*a* comprise very sharp corners 30*a* formed at a junction between a top surface 39*a* of mold 32*a* and side surfaces 37 of mold 32*a* (i.e., the junction between a top surface 39*a* of mold 32*a* and side surfaces 37 of mold 32*a* form a ninety degree angle). Corners 30*a* are sharp and therefore they may damage rubbery seals used in an injection molded solder head (e.g., a C4NP injection molded solder head) while solder is injected into cavities 29*a*. The seals form an interface between the injection molded solder head and mold 32*a*. The seals hold in a molten, pressurized solder. Additionally, the seals may be used to enclose an area of vacuum which removes air from the cavities before the solder is injected. As the seals are damaged (i.e., by corners 30*a*), debris (from the rubber seals) may contaminate the solder that is injected into cavities 29*a*. Systems 2*a*-2*d* of FIGS. 2-5 are used to remove sharp edges 30*a* as described, infra.

Figure 1B:
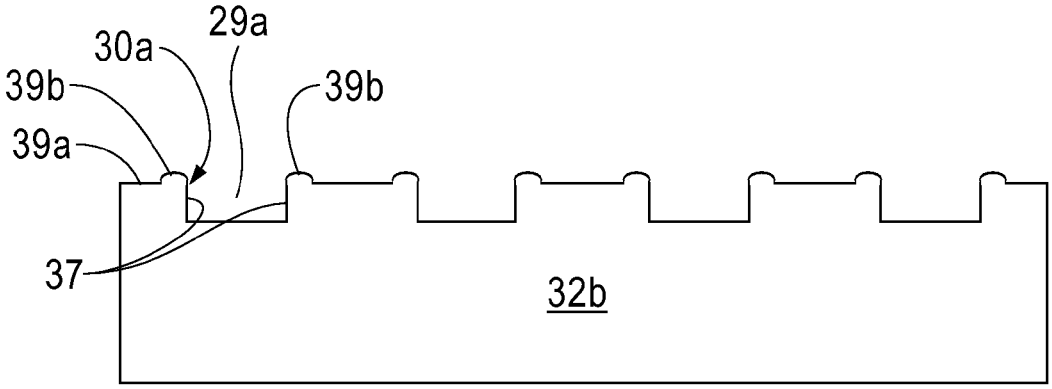
FIG. 1B illustrates a cross sectional view of a first alternative mold used for applying solder to an electrical structure, in accordance with embodiments of the present invention.

FIG. 1B illustrates a cross sectional view of a mold 32*b* similar to mold 32*a* of FIG. 1 used for forming solder balls and applying the solder balls to an electrical structure, in accordance with embodiments of the present invention. In contrast with mold 32*a* of FIG. 1, mold 32 *b* of FIG. 2 comprises rounded portions 39*b* of top surface 39*a* (i.e., extending above top surface 39*a*) of mold 32*b* forming a perimeter surrounding cavities 29*a*. Rounded portions 39*b* may be formed while using a laser process for forming cavities 29*a*. Rounded portions 39*b* may damage rubbery seals used in an injection molded solder head (e.g., a C4NP injection molded solder head) while solder is injected into cavities 29*a* and therefore systems 2*a*-2*d* of FIGS. 2-5 are user to remove rounded portions 39*b* as described, infra.

Figure 1C:
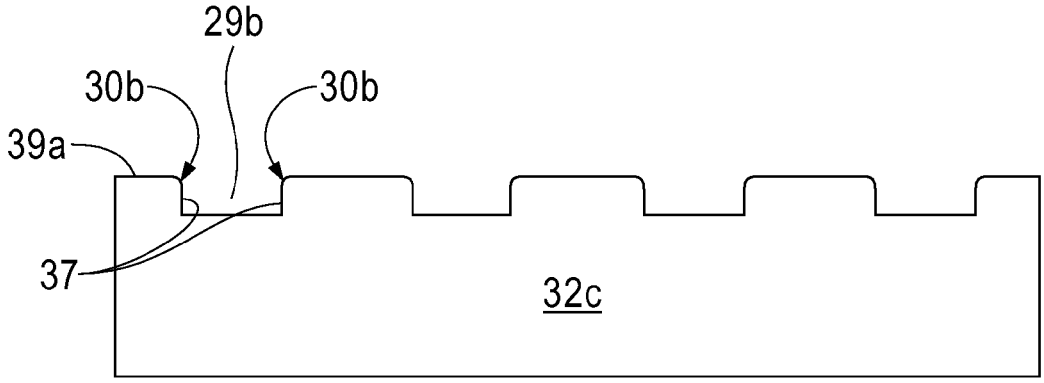
FIG. 1C illustrates a cross sectional view of a second alternative mold used for applying solder to an electrical structure, in accordance with embodiments of the present invention.
Figure 2:
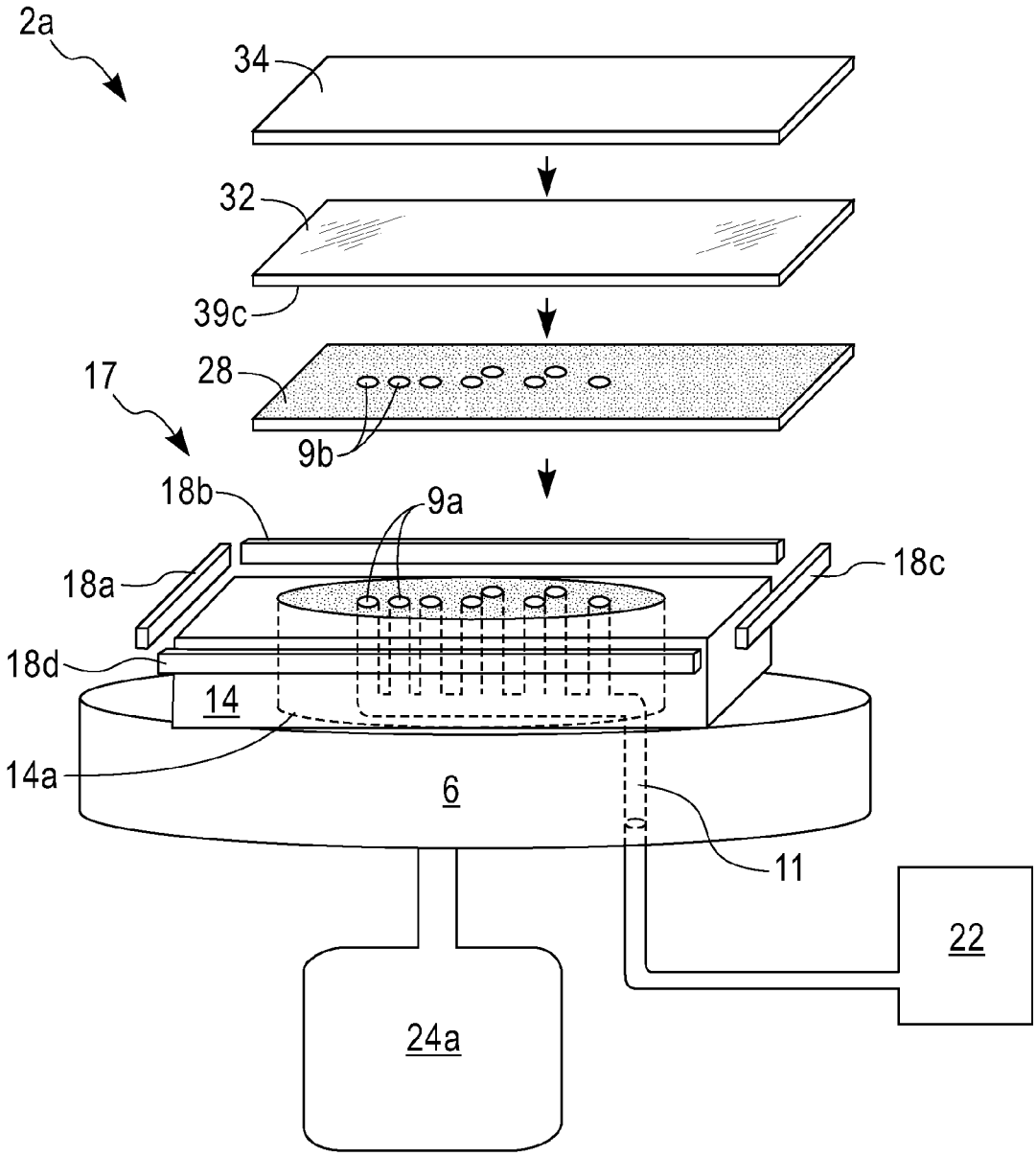
FIG. 2 illustrates an exploded view of a system used for removing the sharp corners of FIG. 1A and/or the rounded portions of FIG. 1B, in accordance with embodiments of the present invention.

FIG. 1C illustrates a cross sectional view of a mold 32*c* formed from mold 32*a* of FIG. 1 or mold 32*b* of FIG. 2, in accordance with embodiments of the present invention. In contrast with mold 32*a* of FIG. 1, mold 32*c* of FIG. 3 comprises rounded edges 30*b* formed a junction between top surface 39*a* of mold 32*c* and side surfaces 37 of cavities 29*b*. In contrast with mold 32*b* of FIG. 2, mold 32*c* of FIG. 3 comprises rounded edges 30*b* formed a junction between top surface 39*a* of mold 32*c* and side surfaces 37 of cavities 29*b*. Additionally, rounded portions 39*b* have been removed. Removing rounded portions 39*b* and sharp corners 39*a* prevents damage to the rubbery seals used in an injection molded solder head during a solder injection process because rounded corners will not damage the rubbery seals. Rounded portions 39*b* and sharp corners 39*a* are removed using systems 2*a*-2*d* of FIGS. 2-5 and the algorithm of FIG. 6 as described, infra.

FIG. 2 illustrates an exploded view of a system 2*a* used for removing sharp corners 30*a* of FIG. 1A and/or rounded portions 39*b* of FIG. 1B, in accordance with embodiments of the present invention. System 2*a* comprises a polishing tool 17, retaining rails 18*a* . . . 18*d*, mold 32 (representing any of molds 32*a* . . . 32*c*), a vacuum device 22, and a polishing pad 34. Polishing tool 17 comprises a mounting plate 6, a chuck plate 14 (comprising interior portion 14*a*) over and mechanically attached to mounting plate 6, and a pad structure 28 over and mechanically attached to chuck plate 14. Each of mounting plate 6, chuck plate 14, and interior portion 14*a* of chuck plate may comprise any type of material including, inter alia, metal, plastic, etc. Mounting plate 6 may comprise any shape including, inter alia, rectangular, circular, triangular, etc. Chuck plate may comprise any shape including, inter alia, rectangular, circular, triangular, etc. Interior portion 14*a* of chuck plate 14 comprises thru-holes 9*a*. Interior portion 14*a* may comprise any shape including, inter alia, rectangular, circular, triangular, etc. Pad structure 28 thru-holes 9*b*. Each of thru-holes 9*b* is located over an associated thru-hole of thru-holes 9*a*. Thru-holes 9*a* and 9*b* are all connected together via tube 11. Tube 11 is connected to vacuum device 22. Vacuum device 22 forms a vacuum within thru-holes 9*a* and 9*b*. The vacuum within thru-holes 9*a* and 9*b* mechanically attaches a bottom surface 39*c* of mold 32 to pad structure 28 thereby attaching pad structure 28 to chuck plate 14. Additionally, an adhesive may be used to attach pad structure 28 to chuck plate 14. Retaining rails 18*a* . . . 18*d* may be mechanically attached to chuck plate 14. Retaining rails 18*a* . . . 18*d* may be mechanically attached to chuck plate 14 using any attachment device/substance such as, inter alia, screws, rivets, adhesive, welding materials, etc. Retaining rails 18*a* . . . 18*d* are used to keep mold 32 from shifting during a polishing process. Retaining rails 18*a* . . . 18*d* may comprise any type of material including, inter alia, metal, plastic, etc. Retaining rails 18*a* . . . 18*d* are shown for illustration purposes. Note that any type of retaining structure (e.g., a retaining ring, a retaining box, etc) may be substituted for retaining rails 18*a* . . . 18*d*. A motor 24*a* (e.g., electric, gas, etc) may be attached to mounting plate 6. Motor 24*a* is used to rotate in any direction (e.g., clockwise, counter clockwise, etc), polishing tool 17 (i.e., with mold 32 attached) over (and in contact with) polishing pad 34 in order to remove sharp corners 30*a* of FIG. 1A and/or rounded portions 39*b* of FIG. 1B. Polishing pad 34 may comprise an abrasive surface that removes corners 30*a* of FIG. 1A and/or rounded portions 39*b* of FIG. 1B as the rotating mold 32 contacts polishing pad 34. Polishing pad 34 may comprise any type of polishing pad including, inter alia, a Rohm-Haas Embossed Polytex pad (i.e., soft and compliant). A polishing liquid (e.g., a slurry comprising abrasive particles) may be continuously applied (e.g., using a dispensing apparatus) to polishing pad 34 to aid polishing pad 34 in removing corners 30*a* of FIG. 1A and/or rounded portions 39*b* of FIG. 1B. For example, colloidal silica slurry with a 30-N-50, 50 nm particle size and a 30% solid in an Ammonium Hydroxide chemistry with a pH of 10 may be used. Polishing tool 17 (i.e., with mold 32 attached) may be rotated at any speed (e.g., 1-1000 RPMs) and for any time period (e.g., 10 seconds to 4 minutes) over (and in contact with) polishing pad 34 in order to remove sharp corners 30*a* of FIG. 1A and/or rounded portions 39*b* of FIG. 1B. Additionally, a specified amount of pressure (e.g., 2-30 PSI) may be applied to polishing tool 17 during the rotation process.

Figure 3:
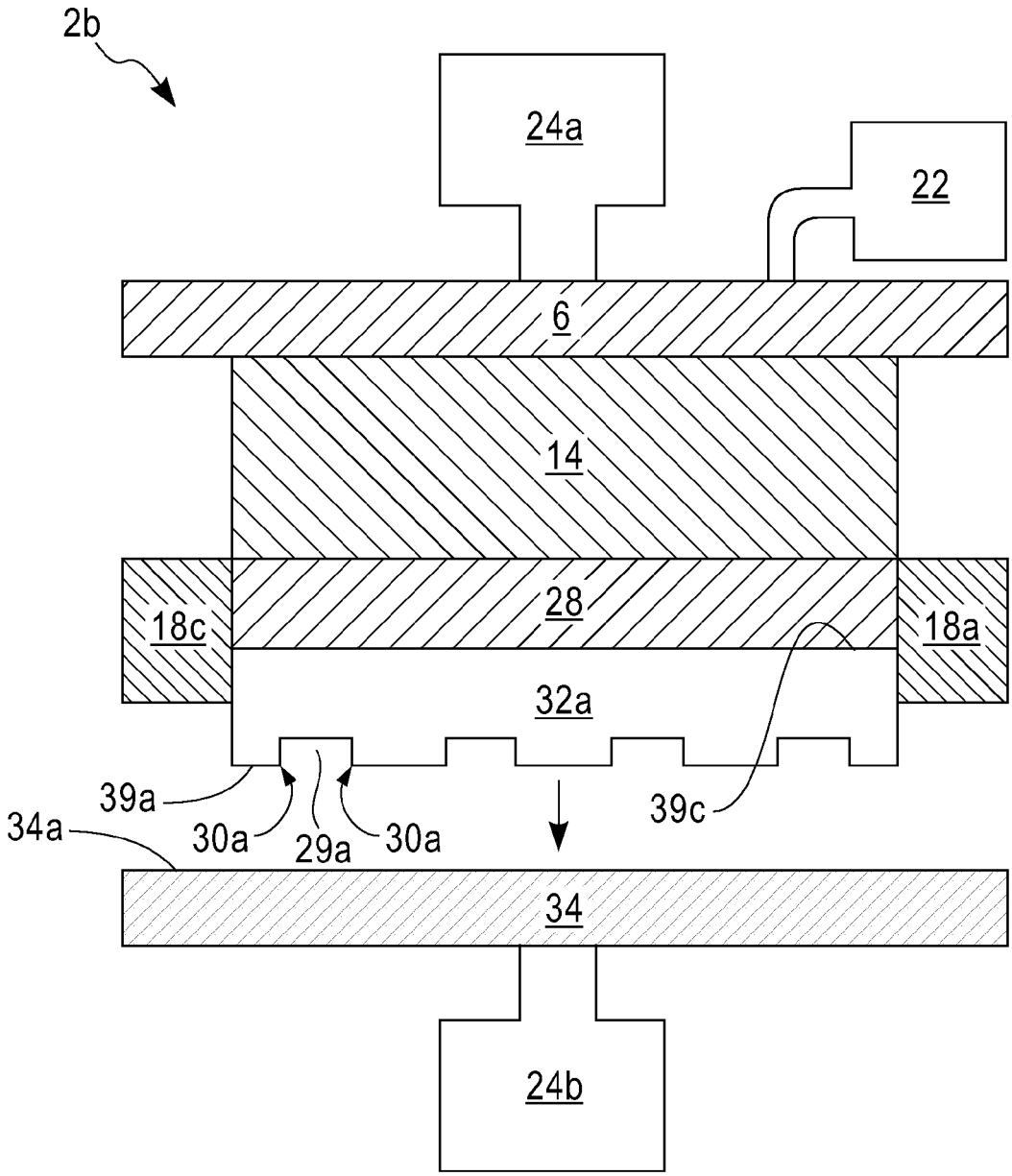
FIG. 3 illustrates a cross sectional view of a system used for removing sharp corners of FIG. 1A, in accordance with embodiments of the present invention.

FIG. 3 illustrates a cross sectional view of a system 2*b* (similar to system 2*a* of FIG. 2) used for removing sharp corners 30*a* of mold 32*a*, in accordance with embodiments of the present invention. In addition to system 2*a* of FIG. 2, system 2*b* of FIG. 3 comprises an additional motor 24*b* (e.g., electric, gas, etc) for rotating polishing pad 34. Motor 24*b* is used to rotate in any direction (e.g., clockwise, counter clockwise, etc), polishing pad 34 in order to remove sharp corners 30*a*. For example, motor 24*b* could be rotated in a same direction as motor 24*a*. Alternatively, motor 24*b* could be rotated in a different direction (e.g., an opposite direction) from motor 24*a*. Motor 24*b* could be rotated at a same speed or different speed from motor 24*a*. Motor 24*b* could be rotated for a same amount of time or for a different amount of time as motor 24*a*. Additionally, a process could be performed wherein motor 24*b* could be rotated in a first direction, at a first speed, for a first specified amount of time, while motor 24*a* is rotated in a second direction, at a second speed, for a second specified amount of time. Then both motors could be stopped (i.e., rotation stopped) and motor 24*b* could be rotated in the second direction, at a third speed, for a third specified amount of time, while motor 24*a* is rotated in a first direction, at a fourth speed, for a fourth specified amount of time.

Figure 4:
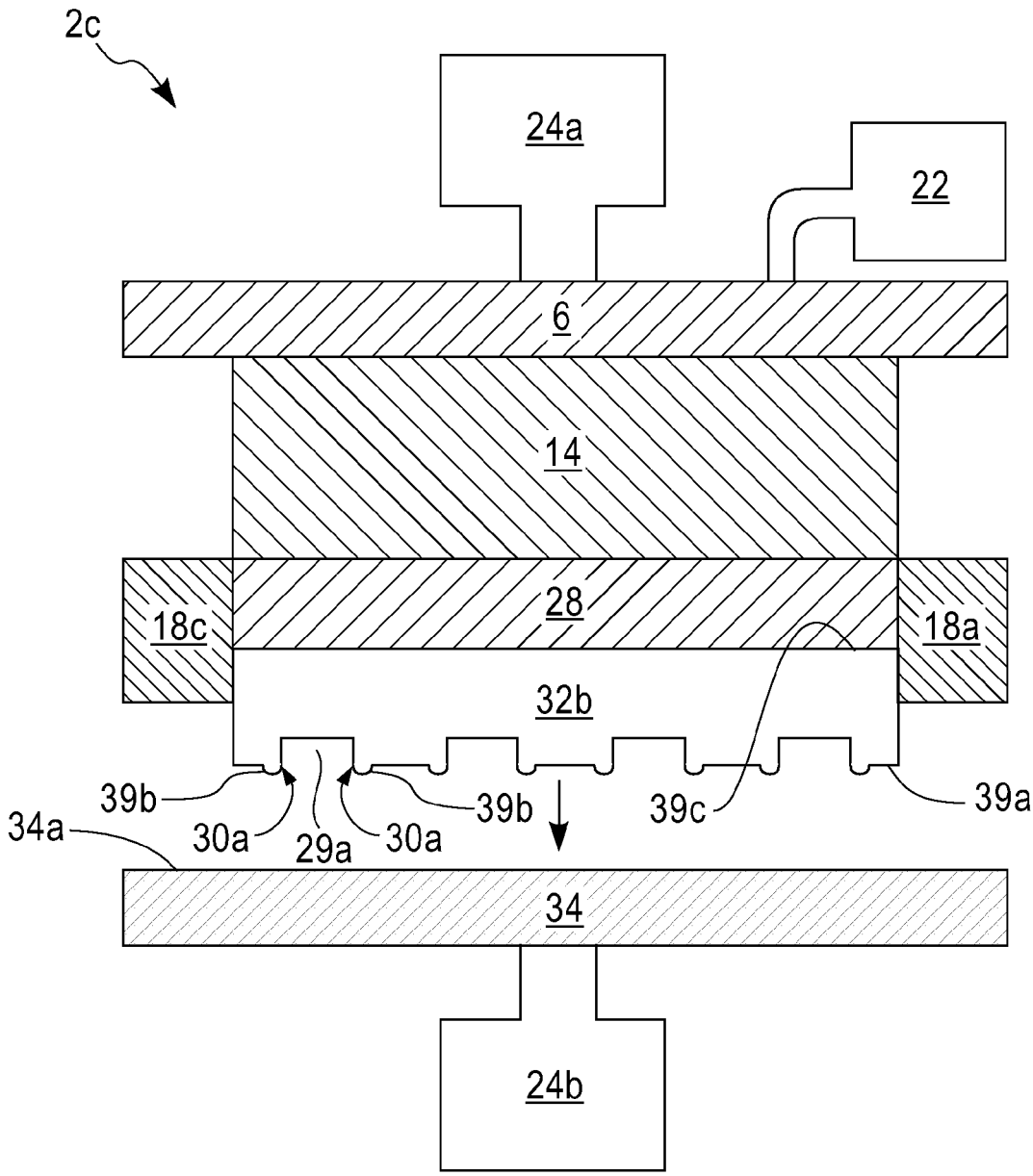
FIG. 4 illustrates a cross sectional view of a system used for removing rounded portions of FIG. 1B, in accordance with embodiments of the present invention.

FIG. 4 illustrates a cross sectional view of a system 2*c* (similar to system 2*b* of FIG. 3) used for removing sharp corners 30*a* and/or rounded portions 39*b* of mold 32*b*, in accordance with embodiments of the present invention. In contrast with system 2*b* of FIG. 3, system 2*c* of FIG. 4 comprises mold 32*b* comprising rounded portions 39*b*.

Figure 5:
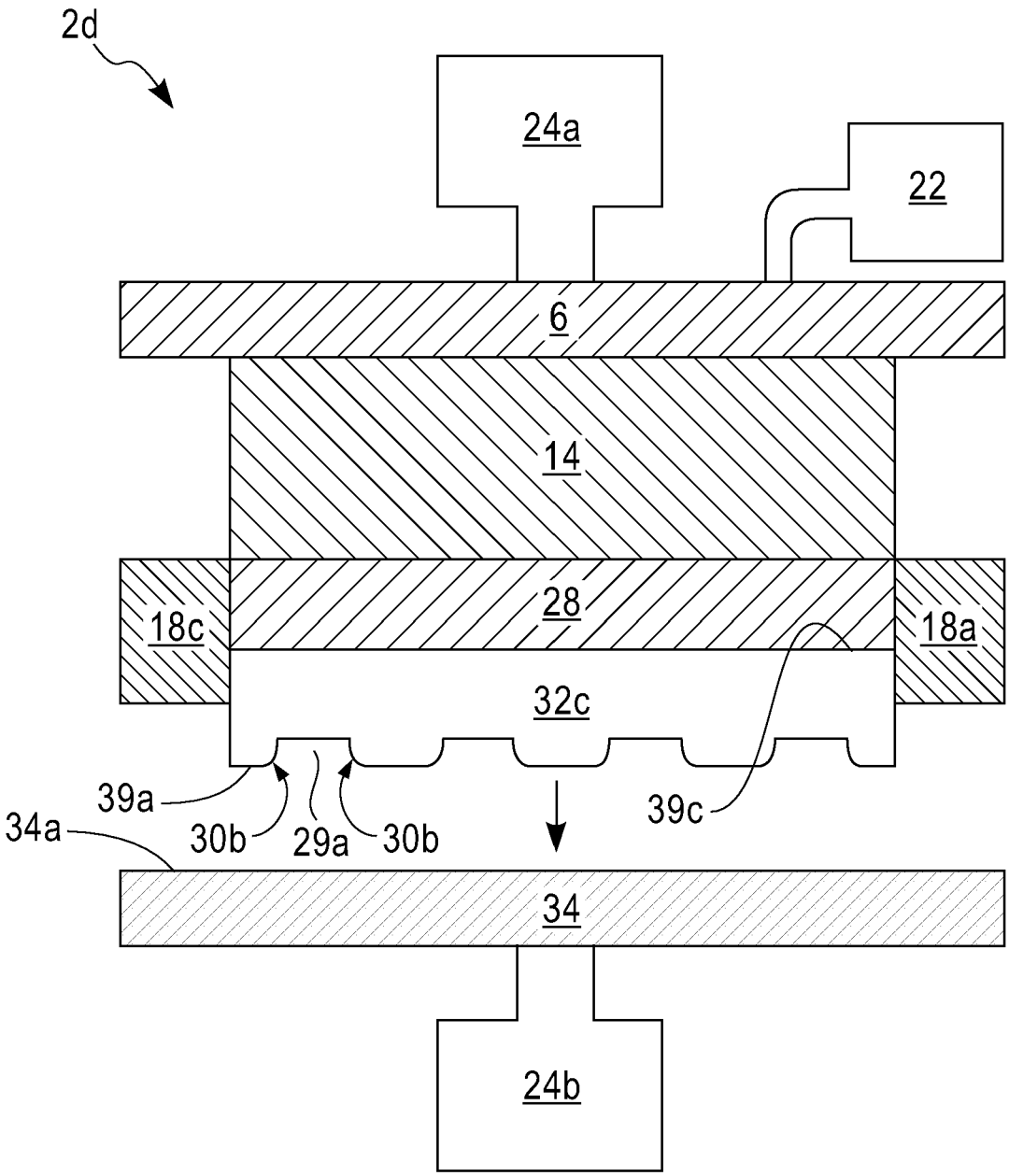
FIG. 5 illustrates a cross sectional view of a system comprising a mold with rounded corners, in accordance with embodiments of the present invention.

FIG. 5 illustrates a cross sectional view of a system 2*d* similar to system 2*c* of FIG. 4, in accordance with embodiments of the present invention. In contrast with system 2*b* of FIG. 3 and system 2*c* of FIG. 4, system 2*d* of FIG. 5 comprises a mold 32*c* comprising rounded edges 30*b* formed a junction between top surface 39*a* of mold 32*c* and side surfaces 37 of cavities 29*b*. Rounded edges 30*b* are formed as a result of the polishing process performed and described with reference to FIGS. 1-4.

Figure 6:
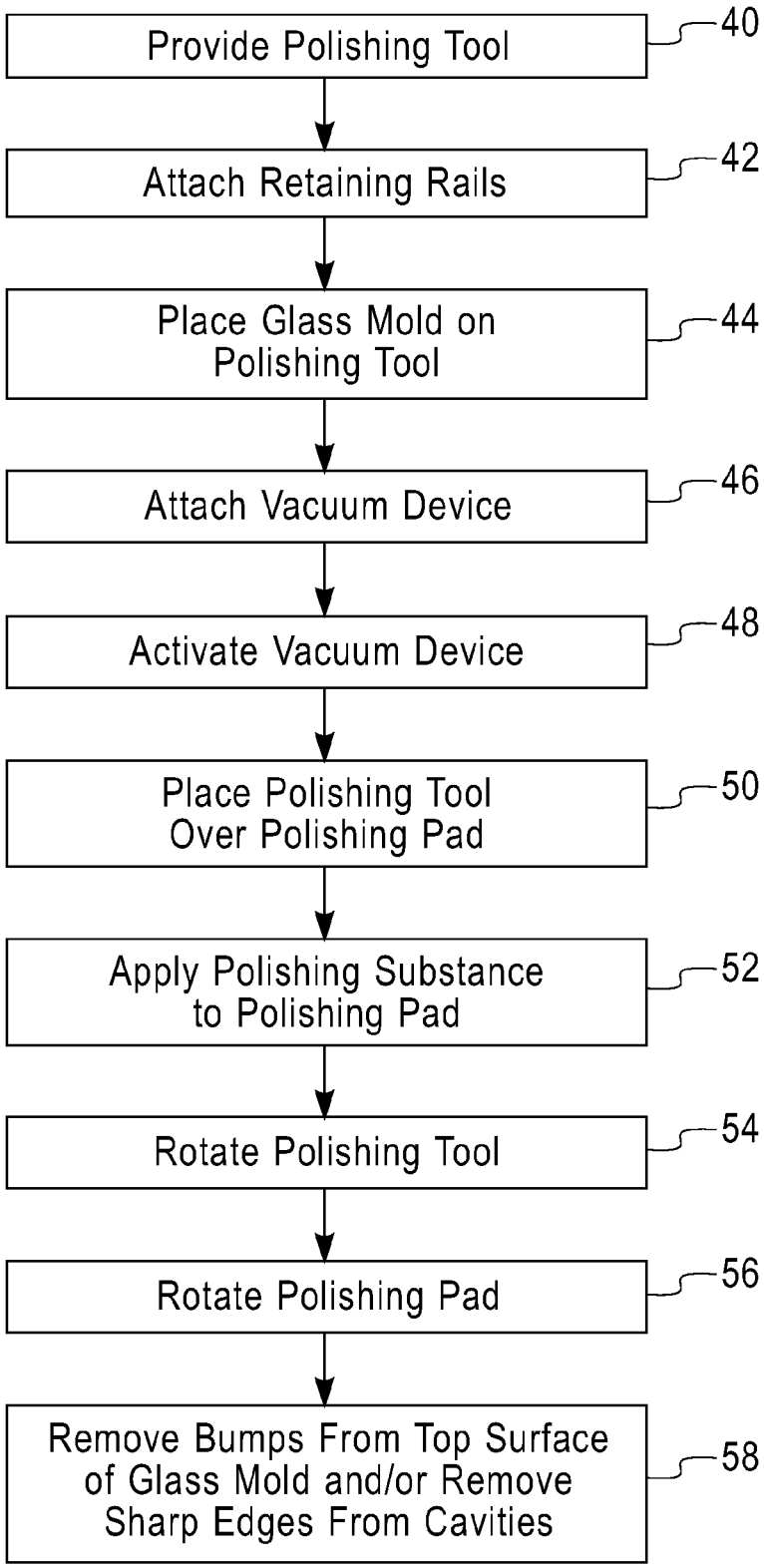
FIG. 6 illustrates a flowchart detailing process steps for forming the mold of FIG. 3, in accordance with embodiments of the present invention.

FIG. 6 illustrates a flowchart detailing process steps for forming mold 32*c* of FIG. 3, in accordance with embodiments of the present invention. Mold 32*c* is formed from mold 32*a* of FIG. 1 and/or mold 32*b* of FIG. 2. In step 40, a polishing tool (e.g., polishing tool 17 of FIG. 2) provided. The polishing tool comprises a mounting plate (e.g., mounting plate 6 of FIG. 2), a chuck plate (e.g., chuck plate 14 of FIG. 2) over and mechanically attached to the mounting plate, and a pad structure (e.g., pad structure 28 of FIG. 2) over and mechanically attached to the chuck plate. In step 42, retaining rails or a retaining structure (e.g., retaining rails 18*a* . . . 18*d* of FIG. 2) are mechanically attached to the chuck plate using any attachment device/substance such as, inter alia, screws, rivets, adhesive, welding materials, etc. The retaining rails are used to keep a mold (e.g., mold 32 of FIG. 2) from shifting during a polishing process. In step 44, the mold (i.e., comprising a plurality of cavities 29*a* of FIG. 1A, sharp corners 30*a* of FIG. 1A, and/or rounded portions 39*b* of FIG. 1B is placed on the pad structure and within a perimeter formed the retaining rails. A bottom surface of the glass mold is in contact with the pad structure. In step 46 a vacuum device (e.g., vacuum device 22 of FIG. 2) is attached to the chuck plate. In step 48, the vacuum device is activated such that a vacuum is formed within each of thru-hole 9*a* and 9*b* of FIG. of FIG. 2. The vacuum mechanically attaches the bottom surface of the mold to the pad structure (and the polishing tool). In step 50, the polishing tool comprising the mold mechanically attached is placed over the polishing pad such that the top surface (and sharp corners 30*a* of FIG. 1A, and/or rounded portions 39*b* of FIG. 1B) of the glass mold is in contact with the polishing pad. Step 50 may be performed after step 48. In step 52, a polishing substance/liquid (e.g., a slurry comprising abrasive particles) is optionally applied to the polishing pad. Step 52 may be performed after or before step 50. In step 54, the polishing tool is rotated by a motor (e.g., at a first speed and in a first direction). Step 54 may be performed before or after step 52. In step 56, the polishing pad is rotated by a motor (e.g., at a second speed and in a second direction). In step 58, sharp corners 30*a* of FIG. 1A, and/or rounded portions 39*b* of FIG. 1B are removed as a result of steps 54 and/or 56.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A method comprising:

providing a polishing tool comprising mounting plate, a chuck plate over and mechanically attached to said mounting plate, and a pad structure over and mechanically attached to said chuck plate, wherein said chuck plate comprises a first plurality of thru-holes, wherein said pad structure comprises a second plurality of thru-holes, and wherein each thru-hole of said second plurality of thru-holes is located over an associated thru-hole of said first plurality of thru-holes;

mechanically attaching a retaining structure to said chuck plate;

placing a glass mold comprising a plurality of cavities on said pad structure and within a perimeter formed by said retaining structure, wherein a bottom surface of said glass mold is in contact with said pad structure, and wherein said plurality of cavities are formed within a top surface of said glass mold;

attaching a vacuum device to said chuck plate;

activating said vacuum device such that a vacuum is formed within each said thru-hole of said second plurality of thru-holes and each said associated thru-hole of said first plurality of thru-holes, wherein said vacuum mechanically attaches said bottom surface of said glass mold to said pad structure;

placing said polishing tool comprising said glass mold mechanically attached to said pad structure over a polishing pad such that said top surface of said glass mold is in contact with said polishing pad;

applying a polishing substance to said polishing pad;

first rotating at a first speed and in a first direction, said polishing tool comprising said glass mold mechanically attached to said pad structure; and polishing for a specified time period, said glass mold.

2. The method of claim 1, wherein each portion of a plurality of portions of said top surface of said glass mold is raised above all other portions of said top surface of said glass mold and forms a perimeter around an associated cavity of said plurality of cavities, and wherein said polishing said glass mold comprises removing said plurality of portions of said top surface of said glass mold.

3. The method of claim 1, wherein said polishing said glass mold comprises removing portions of sharp corners formed at a junction between said top surface of said glass mold and side surfaces of said cavities resulting in rounded corners formed between said top surface of said glass mold and said side surfaces of said cavities.

4. The method of claim 3, wherein each sharp corner of said sharp corners forms an angle of ninety degrees.

5. The method of claim 1, further comprising:

disabling said first rotating; and second rotating, at said first speed and in a second direction opposite to said first direction, said polishing tool comprising said glass mold mechanically attached to said pad structure, wherein said second rotating is performed after said disabling.

6. The method of claim 1, further comprising:

disabling said first rotating; and second rotating, at a second speed and in a second direction opposite to said first direction, said polishing tool comprising said glass mold mechanically attached to said pad structure, wherein said second rotating is performed after said disabling, and wherein said second speed differs from said first speed.

7. The method of claim 1, rotating said polishing pad at said first speed and in said first direction.

8. The method of claim 1, rotating said polishing pad at a second speed and in said first direction, wherein said second speed differs from said first speed.

9. The method of claim 1, rotating said polishing pad at said first speed and in a second direction opposite to said first direction.

10. The method of claim 1, rotating said polishing pad at a second speed and in a second direction opposite to said first direction.

11. The method of claim 1, applying a specified amount of pressure to said polishing tool during said first rotating.

12. The method of claim 1, wherein said first rotating is performed by a motor.

13. The method of claim 1, wherein said mechanically attaching said retaining structure to said chuck plate comprises using of screws to perform said mechanically attaching.

14. The method of claim 1, further comprising using said glass mold is used for applying injection molded solder structures to an electrical structure.

15. The method of claim 1, wherein said polishing substance comprises a slurry comprising abrasive particles.

16. A structure comprising:

a polishing tool comprising a mounting plate, a chuck plate over and mechanically attached to said mounting plate, and a pad structure over and mechanically attached to said chuck plate, wherein said chuck plate comprises a first plurality of thru-holes, wherein said pad structure comprises a second plurality of thru-holes, and wherein each thru-hole of said second plurality of thru-holes is located over an associated thru-hole of said first plurality of thru-holes;

a retaining structure mechanically attached to said chuck plate;

a glass mold comprising a plurality of cavities placed on said pad structure and within a perimeter formed by said retaining structure, wherein a bottom surface of said glass mold is in contact with said pad structure, and wherein said plurality of cavities are formed within a top surface of said glass mold;

a vacuum device attached to said chuck plate, wherein said vacuum device is configured to form a vacuum within each said thru-hole of said second plurality of thru-holes and each said associated thru-hole of said first plurality of thru-holes, and wherein said vacuum mechanically attaches said bottom surface of said glass mold to said pad structure; and a polishing pad in mechanical contact with said top surface of said glass mold, wherein said polishing tool is configured to rotate at a first speed and in a first direction and polish said glass mold for a specified time period;

a first motor assembly directly attached to said polishing pad, wherein said first motor assembly is configured to rotate said polishing pad; and a second motor assembly attached to said mounting plate, wherein said second motor assembly is configured to rotate said polishing tool at said first speed and in said first direction and polish said glass mold for said specified time period.

17. The structure of claim 16, wherein said chuck plate comprises a rectangular shape.

18. The structure of claim 16, wherein said pad structure comprises a rectangular shape.

19. The structure of claim 16, wherein said glass mold comprises a rectangular shape.

20. The structure of claim 16, wherein said glass mold comprises a plurality structures formed from portions of said top surface, wherein each structure of said plurality of structures is raised above all other portions of said top surface of said glass mold and forms a perimeter around an associated cavity of said plurality of cavities, and wherein said polishing tool is configured to remove said plurality of structures.

21. The structure of claim 16, wherein said glass mold comprises sharp corners formed at a junction between said top surface of said glass mold and side surfaces of said cavities, and wherein said polishing tool is configured to remove said sharp corners resulting in rounded corners formed between said top surface of said glass mold and said side surfaces of said cavities.

22. The structure of claim 16, wherein said retaining structure comprises a plurality of retaining rails, and wherein each retaining rail of said plurality of retaining rails is mechanically attached to said chuck plate.

23. The structure of claim 16, wherein said first motor assembly is configured to rotate said polishing pad a second speed differing from said first speed and in a second direction differing from said first direction.

* * * * *